US012520981B2

(12) United States Patent
Duffaut

(10) Patent No.: US 12,520,981 B2
(45) Date of Patent: Jan. 13, 2026

(54) ANTI-THEFT SYSTEMS AND METHODS FOR AUTOMATIC SWIMMING POOL CLEANERS

(71) Applicant: ZODIAC POOL CARE EUROPE, Belberaud (FR)

(72) Inventor: Simon Duffaut, Castelginest (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 472 days.

(21) Appl. No.: 17/984,684

(22) Filed: Nov. 10, 2022

(65) Prior Publication Data

US 2023/0148817 A1 May 18, 2023

Related U.S. Application Data

(60) Provisional application No. 63/278,631, filed on Nov. 12, 2021.

(51) Int. Cl.

| | |
|---|---|
| ***A47L 9/28*** | (2006.01) |
| ***A47L 9/30*** | (2006.01) |
| ***E04H 4/16*** | (2006.01) |

(52) U.S. Cl.

CPC ..... *A47L 9/2889* (2013.01); *A47L 9/30* (2013.01); *E04H 4/1654* (2013.01); *A47L 2201/04* (2013.01)

(58) Field of Classification Search

CPC ..... A47L 9/2889; A47L 9/30; A47L 2201/04; E04H 4/1654; G06F 21/32; G06F 21/554

See application file for complete search history.

(56) References Cited

U.S. PATENT DOCUMENTS

| | | | |
|---|---|---|---|
| 8,771,504 | B2 | 7/2014 | Mastio et al. |
| 9,250,626 | B2 | 2/2016 | Michelon |
| 9,611,688 | B1 | 4/2017 | Vanderbent, Jr. et al. |
| 2013/0150028 | A1 | 6/2013 | Akins et al. |
| 2014/0137891 | A1 | 5/2014 | Hanan et al. |
| 2019/0170849 | A1 | 6/2019 | Hermes et al. |
| 2020/0311227 | A1* | 10/2020 | Bennett ..... G06F 21/602 |

FOREIGN PATENT DOCUMENTS

AU 2017101287 A4 11/2017

OTHER PUBLICATIONS

International Application No. PCT/IB2022/060848, Invitation to Pay Additional Fees and, Where Applicable Protest Fee mailed on Feb. 14, 2023, 4 pages.

International Application No. PCT/IB2022/060848, International Preliminary Report on Patentability mailed on May 23, 2024, 10 pages.

International Application No. PCT/IB2022/060848, International Search Report and Written Opinion mailed on Apr. 5, 2023, 15 pages.

* cited by examiner

*Primary Examiner* — An T Nguyen

(74) *Attorney, Agent, or Firm* — Kilpatrick Townsend & Stockton LLP

(57) ABSTRACT

A cleaning system for swimming pools and spas may include an automatic swimming pool cleaner and an anti-theft system for the automatic swimming pool cleaner. In some cases, the anti-theft system may be an active system generating an active response based on a safety situation. Additionally or alternatively, the anti-theft system may provide increased prevention and/or deterrence to theft.

19 Claims, 1 Drawing Sheet

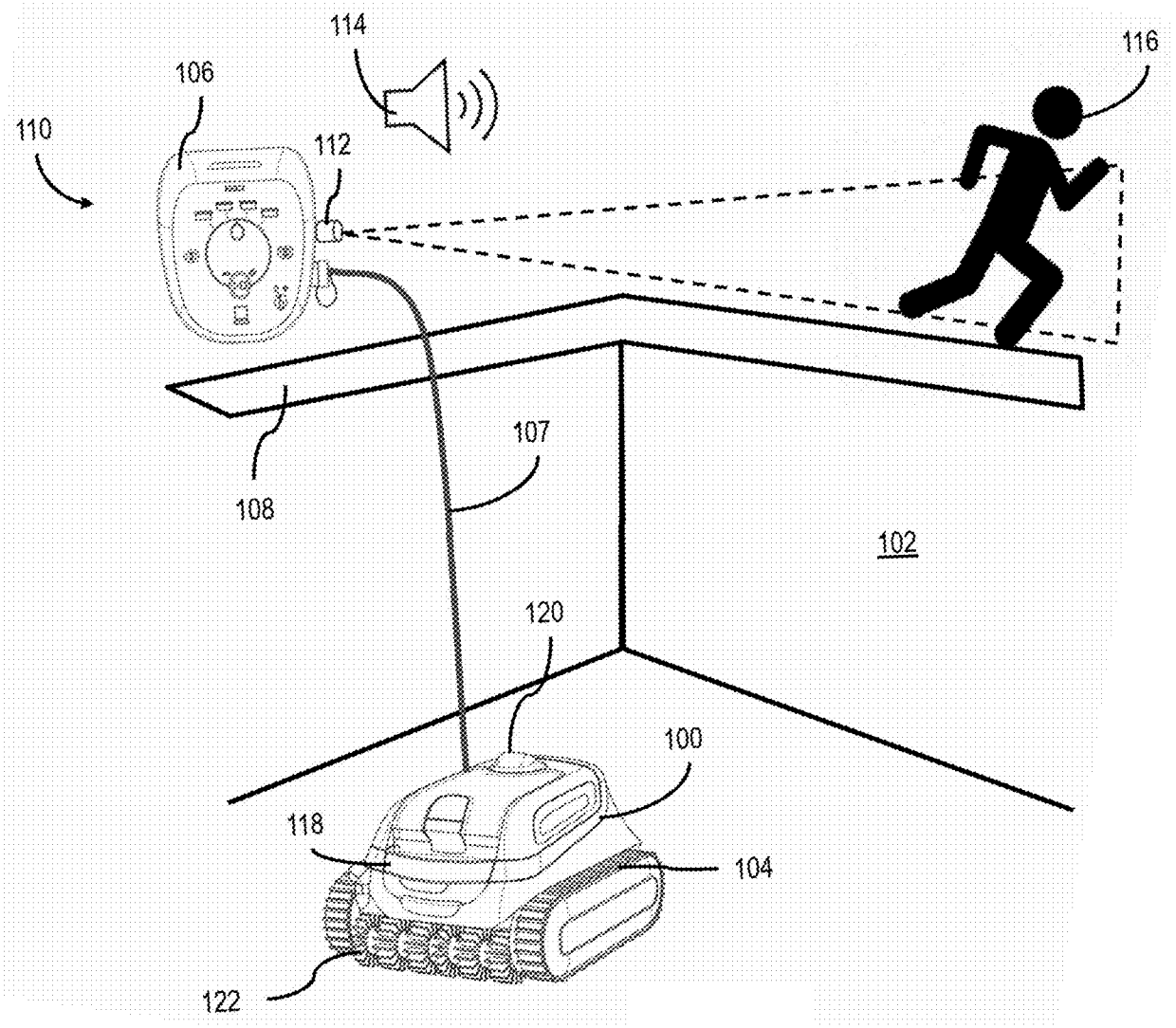
116
114
112
106
110
108
107
102
120
100
104
118
122

ANTI-THEFT SYSTEMS AND METHODS FOR AUTOMATIC SWIMMING POOL CLEANERS

REFERENCE TO RELATED APPLICATION

This application claims the benefit of U.S. Provisional Patent Application No. 63/278,631, filed on Nov. 12, 2021 and entitled ANTI-THEFT SYSTEMS AND METHODS FOR AUTOMATIC SWIMMING POOL CLEANERS, the content of which is hereby incorporated by reference in its entirety.

FIELD OF THE INVENTION

This application relates to cleaning devices for water-containing vessels such as swimming pools and spas, among others, and more particularly, to anti-theft systems and methods for such cleaning devices.

BACKGROUND OF THE INVENTION

Automatic swimming pool cleaners (APCs) are well known. These cleaners are often characterized as either "hydraulic" or "robotic" (or "electric"), depending on the source of their motive power. For example, hydraulic cleaners typically use pressurized or depressurized water to cause their autonomous movement within pools, while robotic cleaners typically use an electric motor to cause their movement. Moreover, hydraulic cleaners frequently are sub-categorized as either "pressure-side" or "suction-side" devices, where pressure-side cleaners receive pressurized water output from an associated water circulation pump while suction-side cleaners are connected to an inlet of the pump. APCs, regardless of type, are a substantial monetary investment for customers. However, APCs are increasingly targeted and stolen by thieves, which in turn creates a loss for the customer, interrupts pool maintenance, and requires the customer to obtain a new APC.

SUMMARY

Described herein are anti-theft systems and methods for APCs as well as APCs incorporating such systems.

According to certain embodiments, a cleaning system includes an APC and an anti-theft system associated with the APC.

The anti-theft system may be an active system and/or a passive system. The anti-theft system may be on the APC and/or remote from the APC.

In certain embodiments, the anti-theft system includes a controller that receives data from a sensor and generates a safety response responsive to the data when the data indicates a safety situation for the APC.

Optionally, the data includes, but is not limited to, one or more of a predetermined number of incorrect pin codes for the automatic swimming pool cleaner, movement detected by an accelerometer of the automatic swimming pool cleaner, a location of the automatic swimming pool cleaner provided by a location service, movement detected based on a change in wireless signals, a video or picture provided by a camera associated with the automatic swimming pool cleaner, movement detected by a movement detector, movement detected by a water flow detector, an incorrect fingerprint or other personal recognition, an incorrect pattern recognition, and/or a network not being detected or recognized.

Optionally, the safety response includes, but is not limited to, one or more of immobilizing the automatic swimming pool cleaner, locking the automatic swimming pool cleaner, generating an alarm or notification on the automatic swimming pool cleaner, sending an alarm or notification to an owner or user of the automatic swimming pool cleaner, sending an alarm or notification to a third party, and/or generating an alarm or notification in a region associated with the automatic swimming pool cleaner.

According to certain embodiments, an anti-theft system for an APC includes a controller and at least one sensor communicatively coupled to the controller. The controller may generate a safety response responsive to data from the at least one sensor indicating a safety situation for the APC.

According to certain embodiments, a method of protecting an APC includes monitoring the APC using an anti-theft system and generating a safety response with the anti-theft system responsive to a safety situation.

Various implementations described herein may include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The specification makes reference to the following appended figures, in which use of like reference numerals in different FIGURES is intended to illustrate like or analogous components.

FIG. 1 illustrates a pool system with an anti-theft system for an APC according to embodiments.

DETAILED DESCRIPTION

Described herein are anti-theft systems and methods for APCs, as well as APCs incorporating such systems. The anti-theft systems and methods may be various active and/or passive systems and methods for preventing and/or deterring potential theft of an APC. The anti-theft systems described herein may be on the APC itself, although they need not be in other embodiments. Moreover, in certain embodiments, more than one type of anti-theft system may be present or provided with an APC to provide increased prevention and/or deterrence to theft. The anti-theft systems described herein are not limited to APCs and may be used with other types of pool equipment as desired. Various other benefits and advantages may be realized with the anti-theft systems and methods described herein, as well as APCs and/or other pool equipment incorporating such systems and methods.

FIG. 1 illustrates a swimming pool 102 with pool equipment such as but not limited to an APC 100. In FIG. 1, the APC 100 is illustrated submerged within the swimming pool 102. The APC 100 may be various types of APCs as desired. In the embodiment illustrated, the APC 100 generally includes a body 118 with one or more inlets and one or more outlets 120. The APC 100 may include one or more of a pump, motive elements 104 (e.g., wheels, tracks, etc. such that the APC 100 can move within the swimming pool 102), an optional cleaning device 122 (e.g., a brush assembly or other suitable device), a filter, any suitable electric or other motors, a controller (e.g., processor and memory), an accelerometer, communication modules (e.g., devices facilitating wired and/or wireless communication to and/or form the APC 100, an antenna, sensor, lights, speakers, etc), and/or an on-board power source (e.g., rechargeable batteries). As such, the particular APC 100 illustrated in FIG. 1 should not be considered limiting, and in other embodiments, other types of APCs may be used with fewer, additional, and/or different combinations or types of features as desired, including various electric cleaners and/or hydraulic cleaners. In some non-limiting examples, the APC 100 may include features similar to those discussed in U.S. Pat. No. 9,611,688, U.S. Patent Application Publication No. 2014/0137891, U.S. Pat. Nos. 8,771,504, and/or 9,250,626, each of which is hereby incorporated by reference in its entirety. Moreover, in other embodiments, the pool equipment need not be an APC, and the pool equipment may be other types of pool equipment or other structures for the swimming pool 102 as desired.

Optionally, and as illustrated in FIG. 1, an external control box 106 for controlling the APC 100 is connected to the APC 100 via a cable 107. However, in other embodiments, the APC 100 need not be physically connected to an external device. In such embodiments, the APC 100 may be configured for wireless communication with the external control box 106 and/or with another external device, including but not limited to a user device.

As illustrated in FIG. 1, in certain embodiments, an anti-theft system 110 is included to prevent or deter potential theft of the APC 100 or other pool equipment. The anti-theft system 110 may include various devices and components to provide various types of anti-theft protection as desired, including but not limited to providing warnings, immobilizing the APC 100, and/or tracking the APC 100, among others. Some of these systems and devices are discussed in further detail below. However, the below listing of anti-theft devices and features should not be considered limiting. Moreover, the person of ordinary skill in the art will appreciate that each of the below systems and features may be used independently and/or in conjunction with other features or devices as part of the anti-theft system 110 to provide anti-theft protection as desired.

In the embodiment illustrated in FIG. 1, the anti-theft system 110 is an active system that includes a sensor or detecting device 112 and a response device 114. As discussed in detail below, the detecting device 112 may be various suitable devices or mechanisms for detecting an event associated with the APC 100, and the response device 114 may be various suitable devices or mechanisms for generating and providing a response responsive to the event detected by the detecting device 112. In the embodiment illustrated in FIG. 1, the detecting device 112 and the response device 114 are both remote from the APC 100; however, they need not be in other embodiments, and the detecting device 112 and/or the response device 114 may be provided on the APC 100 as desired. Moreover, while a single detecting device 112 and a single response device 114 are illustrated, any number of detecting devices 112 and/or response devices 114 may be provided as desired.

In the embodiment illustrated in FIG. 1, the detecting device 112 is a motion sensor on the control box 106 and is configured to detect motion from a person 116 on a pool deck 108 surrounding the swimming pool 102. However, in other embodiments, the detecting device 112 may be other types of sensors as desired and/or may be used to detect various other events that may be indicative of a safety issue. As some non-limiting examples, the detecting device 112 may be other types of systems or devices for detecting motion or movement such as an accelerometer on the APC 100 for detecting movement of the APC 100, a motion sensor within the pool 102 remote from the APC 100 and configured to detect movement of the APC 100, a camera on the control box 106 and/or on the APC 100, a communications module that detects motion based on a change in wireless signal strength (e.g., a change in Wi-Fi, Bluetooth®, and/or cellular signal strength), a water movement detector on the APC 100, a geolocation sensor (e.g., GPS) on the APC 100 and/or the control box 106 for detecting a change in location of the APC 100, combinations thereof, and/or other types of movement sensors as desired. Moreover, in other embodiments, the detecting device 112 may detect other types of events that may be indicative of a safety issue as desired. As a non-limiting example, the detecting device 112 may be a communications sensor that detects communications events such as a change or loss of wireless signals, a loss of a known network, an identification of an unrecognized network, combinations thereof, and/or other communication sensors as desired. Various other types of detecting devices 112 for detecting various other types of events may be utilized as desired. Moreover, the detecting device 112 need not be on the control box 106, and may be provided independently and/or with other devices and/or structures within a pool area as desired.

Referring to the response device 114 in FIG. 1, the response device 114 is a speaker remote from the APC 100 and for providing an auditory alert. In other embodiments, other types of response devices 114 providing other types of responses may be utilized as desired, including devices that provide alerting responses (auditory, visual, etc.) and/or control responses.

Response devices 114 for providing alerting responses may be various suitable devices for generating a local or a remote alert or notification, including but not limited to a speaker on the APC 100, a light on the APC 100 and/or the control box 106 having at least one characteristic changed (e.g., activation of the light, a color of the light, a brightness of the light, a pattern of the light, etc.), a text alert, combinations thereof, and/or various other types of response devices 114 as desired. In certain embodiments, the response device 114 is a communications module that generates an alert or notification to a remote device such as a user device of a pool owner, technician, and/or security service. As a non-limiting example, the response device 114 may send an audio, visual, and/or text (e.g., email, SMS, etc.) alert to a user device and/or a device associated with a security service. Such communication may be wired and/or wireless.

Response devices 114 for providing control responses may be various suitable devices for causing an action on the APC 100, control box 106, etc., including but not limited to immobilizing devices or mechanisms for locking the APC 100 and/or otherwise preventing activation, locking devices that lock the APC 100 and/or the control box 106, and/or other suitable control response devices as desired.

In some embodiments, the response device 114 may provide the response automatically based on the detection of an event from the detecting device 112. As a non-limiting example, in FIG. 1, the speaker as the response device 114 may generate an audio alert (e.g., "Good morning Sir") every time that the motion sensor as the detecting device 112 detects motion. In other embodiments, the response device 114 may provide the response based on the detected event meeting predetermined criteria and/or a predetermined threshold. As a non-limiting example, a communications module as the response device 114 may call or send an email to a security service based on a geolocation sensor on the APC 100 detecting that the APC 100 is beyond a predetermined distance from the control box 106. In further embodiments, the response device 114 may provide the response based on any event from the detecting device 112, and the response device 114 may be selectively activated by the user as desired. As a non-limiting example, a remote user may send a wireless signal (e.g., via cellular, Wi-Fi, Bluetooth®, etc.) that locks or otherwise immobilizes the APC 100 at the user's discretion.

In certain examples, a controller communicatively coupled to the detecting device 112 and/or the response device 114 is optionally provided. In some embodiments, the controller may be on the APC 100, although it need not be in other examples. In some embodiments with the controller, the controller may receive data from the detecting device(s) 112 and determine whether the APC 100 has a safety issued based on the data. Responsive to such a determination, the controller may cause the response device 114 to generate the response (e.g., by sending a control signal to the response device 114). In other embodiments, the controller may be used to control the anti-theft system 110 and/or the APC 100 as desired.

While the anti-theft system 110 is illustrated as an active system, in other embodiments, one or more components of the anti-theft system 110 may be passive systems or devices.

As one non-limiting example of a passive system, the anti-theft system 110 may include a fake or nonoperational device or system provided on the APC 100 and/or within a location associated with the APC 100 as a deterring device or system. In such examples, the fake or nonoperational device is not operatively connected to the APC 100 and/or systems associated with the APC 100. Fake or nonoperational devices may include, but are not limited to, a nonoperational human machine interface, a nonoperational camera, a light with a characteristic (e.g., color such as red, blinking etc.) suggesting an active anti-theft system, combinations thereof, and/or other devices or systems as desired.

As another non-limiting example of a passive system, the anti-theft system 110 may include an access system for obtaining access to control the APC 100. The access system may be on the APC 100 itself, on equipment associated with the APC 100, or as otherwise desired. As one non-limiting example, the access system may be a pin code or a pattern code that must be supplied by a potential user to gain access to control the APC 100. In such examples, the pin code or the pattern code may be input on the APC 100, on a user interface associated with the APC 100, on the control box 106, on a cable for the APC 100, on an application, and/or as otherwise desired. As another non-limiting example, the access system may be a personal recognition or biometric recognition system (e.g., fingerprint, facial, etc.) on the APC 100 or a device or system communicatively coupled to the APC 100.

Optionally, a response device 114 may generate a response based on events or actions associated with the passive systems and devices meeting a predetermined threshold. As a non-limiting example, a communications module as the response device 114 may send an email or text to a user based on an incorrect pin or password being entered five (or any number of) times. As another non-limiting example, a speaker as the response device 114 may generate an audio alert (and/or send an email or a text) based on a user's entered biometric information not being a pre-authorized user.

Other non-limiting examples of anti-theft systems according to embodiments of the invention are discussed below, but anti-theft systems are not limited to the below non-limiting examples. In some embodiments, an anti-theft system according to embodiments includes a pin code that is needed to get access to the commands for an APC (e.g., input on the APC itself, the control box, and/or a remote device). In another non-limiting example, an anti-theft system according to embodiments includes moving detection by the accelerometer that can launch a sound alarm or a notification to the user (sound alarm, SMS, email) or to a security service. As a non-limiting example, detected movement of the APC during a time period when the APC is expected to be docked, not in use, etc. may generate a response from the anti-theft system. In another non-limiting example, an anti-theft system according to embodiments includes a location sensor (e.g., global positioning system, geofencing, etc.), and the location sensor may be provided inside the APC and/or control box and can provide the location of the APC and/or control box to the user or a security service. In a further non-limiting example, an anti-theft system according to embodiments includes moving detection by Bluetooth® or Wi-Fi signal (or other wireless signals) decreasing or loss. In yet another non-limiting example, an anti-theft system according to embodiments includes a lock system on the APC, cable or control box. In another non-limiting example, an anti-theft system according to embodiments includes a camera on the control box or on the APC that can identify someone unknown (e.g., based on a detected characteristic of the person in a field of view) and alert the customer. In further non-limiting examples, an anti-theft system according to embodiments includes a fake alarm system with only a human machine interface or fake camera designed to scare a stealer. In other non-limiting examples, an anti-theft system according to embodiments includes the ability to lock the cleaner usage remotely (by Wi-Fi, Bluetooth®, sigfox network, etc.) e.g. by activating a physical lock remotely and/or sending a control signal de-activating the APC and/or otherwise limiting or preventing usage of the APC. In another non-limiting example, an anti-theft system according to embodiments includes a movement detector or water moving detector that can launch a vocal assistant which provides an alert such as (but not limited to) "Good morning Sir" such that the stealer feels spotted. In further non-limiting examples, an anti-theft system according to embodiments includes finger print or other biometric recognition that is needed to use the cleaner. In further non-limiting examples, an anti-theft system according to embodiments includes a pattern recognition that is needed to use the cleaner. In other non-limiting examples, an anti-theft system according to embodiments includes locking the cleaner if a network is not detected or recognized.

Exemplary concepts and combinations of features of the invention may include:

A. A cleaning system includes an APC and an anti-theft system.

B. The cleaning system according to statement A., wherein the anti-theft system is an active system or a passive system.

C. The cleaning system according to statement A. or B., wherein the anti-theft system is on the APC.

D. The cleaning system according to statement A. or B., wherein the anti-theft system is remote from the APC.

E. The cleaning system according to statement A., wherein the anti-theft system comprises a controller configured to receive data from a sensor and generate a safety response responsive to the data, the data indicative of a safety situation for the automatic swimming pool cleaner.

F. The cleaning system according to statement E., wherein the controller is on the APC or remote from the APC.

G. The cleaning system according to statements E. or F., wherein the data comprises at least one of a predetermined number of incorrect pin codes for the APC, movement detected by an accelerometer of the APC, a location of the APC provided by a location service (e.g., GPS), movement detected based on a change in wireless signals (e.g., Wi-Fi or Bluetooth® signals increasing or decreasing in strength), a video or picture provided by a camera associated with the APC, movement detected by a movement detector, movement detected by a water moving detector, an incorrect fingerprint or other personal recognition, an incorrect pattern recognition, and/or a network not being detected or recognized.

H. The cleaning system according to any one of statements E.-G., wherein the safety response comprises at least one of immobilizing the APC, locking the APC, generating an alarm or notification on the APC, sending an alarm or notification to an owner or user of the APC, sending an alarm or notification to a third party (e.g., security service), and/or generating an alarm or notification in a region associated with the APC.

I. An anti-theft system for an APC, the anti-theft system comprising a controller and at least one sensor communicatively coupled to the controller, wherein the controller is configured to generate a safety response responsive to data from the at least one sensor indicating a safety situation for the APC.

J. The anti-theft system according to statement I., wherein the sensor is on the APC or remote from the APC, and/or wherein the controller is on the APC or remote from the APC.

K. The anti-theft system according to statements I. or J., wherein the sensor comprises at least one of an accelerometer, a position sensor, a wireless sensor, a camera, a motion sensor, a personal recognition device, and/or a water moving detector.

L. The anti-theft system according to statement I. or J., wherein the safety response is a passive safety response or an active safety response.

M. A method of protecting an APC, the method comprising monitoring the APC using an anti-theft system and generating a safety response with the anti-theft system responsive to a safety situation.

The method according to statement M, wherein generating the safety response comprises generating a passive safety response or generating an active safety response.

The system or method of any preceding claim, wherein a passive safety response includes but is not limited to an activation of a light associated with the APC.

The system or method of any preceding claim, wherein an active safety response includes but is not limited to control of the APC, control of a response device, or sending an alert to a remote device.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

The foregoing is provided for purposes of illustrating, explaining, and describing embodiments of the present invention. Modifications and adaptations to these embodiments will be apparent to those skilled in the art and may be made without departing from the scope of the invention. Additionally, the word "pool" and phrase "swimming pool" as used herein may also refer to spas or other water containing vessels or structures used for recreation or therapy, including both artificial and natural vessels, structures, and the like.

That which is claimed:

1. A cleaning system comprising:

a swimming pool cleaner; and an anti-theft system for the swimming pool cleaner, wherein the anti-theft system is configured to (i) obtain information about a status of the swimming pool cleaner from at least one sensor, (ii) detecting, based on the obtained information, a change in status of the swimming pool cleaner, (iii) determine whether the change in status corresponds to a safety situation for the swimming pool cleaner, and (iv) responsive to the determination of the safety situation for the swimming pool cleaner, generate a safety response.

2. The cleaning system of claim 1, wherein the anti-theft system is an active system.

3. The cleaning system of claim 1, wherein the anti-theft system is a passive system.

4. The cleaning system of claim 1, wherein the anti-theft system is on the swimming pool cleaner.

5. The cleaning system of claim 1, wherein the anti-theft system is remote from the swimming pool cleaner.

6. The cleaning system of claim 5, wherein the anti-theft system is on a control box associated with the swimming pool cleaner.

7. The cleaning system of claim 1, further comprising a controller, wherein the controller is on the swimming pool cleaner.

8. The cleaning system of claim 1, further comprising a controller, wherein the controller is remote from the swimming pool cleaner.

9. The cleaning system of claim 1, wherein the sensor comprises an accelerometer of the swimming pool cleaner, a location service, a wireless signal emitter or receiver, a camera associated with the swimming pool cleaner, a movement detector, a water flow detector, or a personal recognition device.

10. The cleaning system of claim 1, wherein the safety response comprises at least one of immobilizing the swimming pool cleaner, locking the swimming pool cleaner, generating an alarm or notification on or near the swimming pool cleaner, sending an alarm or notification to an owner or user of the swimming pool cleaner, sending an alarm or notification to a third party, and/or generating an alarm or notification in a region associated with the swimming pool cleaner.

11. A cleaning system comprising:

a swimming pool cleaner; and an anti-theft system for the swimming pool cleaner, the anti-theft system comprising a controller within or external to the swimming pool cleaner, wherein the controller is connected to the swimming pool cleaner via cable or by wireless communication, and wherein the controller is configured to:

receive data from at least one sensor;

detect, based on the received data, a change in status of the swimming pool cleaner;

determine whether the change in status corresponds to a safety situation for the swimming pool cleaner; and generate a safety response responsive to the determination of the safety situation for the swimming pool cleaner.

12. The anti-theft system of claim 11, wherein the sensor is on the swimming pool cleaner.

13. The anti-theft system of claim 11, wherein the controller is on the swimming pool cleaner.

14. The anti-theft system of claim 11, wherein the sensor comprises at least one of an accelerometer, a position sensor, a wireless sensor, a camera, a motion sensor, a personal recognition device, and/or a water moving detector.

15. The anti-theft system of claim 11, wherein the safety response is a passive safety response comprising an activation of a light associated with the swimming pool cleaner.

16. The anti-theft system of claim 11, wherein the safety response is an active safety response, and wherein the controller is configured to control the swimming pool cleaner, control a response device, or send an alert to a remote device as the active safety response.

17. A method of protecting a swimming pool cleaner, the method comprising:

monitoring the swimming pool cleaner using an anti-theft system by:

receiving data from at least one sensor;

detecting, based on the received data, a change in status of the swimming pool cleaner;

determining whether the change in status corresponds to a safety situation for the swimming pool cleaner; and generating a safety response with the anti-theft system responsive to the determination that the change in status corresponds to the safety situation for the swimming pool cleaner.

18. The method of claim 17, wherein generating the safety response comprises generating a passive safety response comprising an activation of a light associated with the swimming pool cleaner.

19. The method of claim 17, wherein generating the safety response comprises generating an active safety response, and wherein generating the active safety response comprises at least one of controlling the swimming pool cleaner, controlling a response device, or sending an alert to a remote device as the active safety response.

* * * * *